US009007356B2

(12) United States Patent
Chiang

(10) Patent No.: US 9,007,356 B2
(45) Date of Patent: Apr. 14, 2015

(54) DRIVING METHOD, DRIVING MODULE AND LIQUID CRYSTAL DISPLAY DEVICE FOR ACHIEVING DOT INVERSION

(75) Inventor: Chia-Yin Chiang, Hsinchu County (TW)

(73) Assignee: NOVATEK Microelectronics Corp., Hsinchu Science Park, Hsin-Chu (TW)

( * ) Notice: Subject to any disclaimer, the term of this patent is extended or adjusted under 35 U.S.C. 154(b) by 949 days.

(21) Appl. No.: 12/879,015

(22) Filed: Sep. 10, 2010

(65) Prior Publication Data

US 2011/0298778 A1 Dec. 8, 2011

Related U.S. Application Data

(60) Provisional application No. 61/350,485, filed on Jun. 2, 2010.

(51) Int. Cl.
*G09G 3/36* (2006.01)

(52) U.S. Cl.
CPC ..... *G09G 3/3648* (2013.01); *G09G 2230/00* (2013.01); *G09G 3/3614* (2013.01); *G09G 2300/0426* (2013.01); *G09G 2320/0209* (2013.01)

(58) Field of Classification Search
CPC ..... G09G 3/3648; G09G 3/3614; G09G 2320/0209; G09G 2230/00; G09G 3/3675–3/3696
USPC ..... 345/84–104, 204–215, 690–699
See application file for complete search history.

(56) References Cited

U.S. PATENT DOCUMENTS

| | | | | |
|---|---|---|---|---|
| 5,606,338 | A * | 2/1997 | Takeda et al. | 345/13 |
| 8,400,378 | B2 * | 3/2013 | Kim et al. | 345/76 |
| 2008/0224984 | A1 * | 9/2008 | Chang | 345/100 |
| 2009/0086994 | A1 * | 4/2009 | Cheng et al. | 381/94.6 |
| 2009/0160832 | A1 * | 6/2009 | Lee | 345/205 |

FOREIGN PATENT DOCUMENTS

| | | |
|---|---|---|
| CN | 101620831 A | 1/2010 |
| TW | 200837706 | 9/2008 |

* cited by examiner

*Primary Examiner* — Dwayne Bost
*Assistant Examiner* — Larry Sternbane
(74) *Attorney, Agent, or Firm* — Winston Hsu; Scott Margo

(57) ABSTRACT

A driving module for a liquid crystal display device with a dual-gate structure includes a data line signal processing unit, for generating a plurality of data driving signals, and a control unit, for shifting a common voltage and the plurality of data driving signals by a specific period relative to a horizontal synchronization signal. The common voltage is an AC common voltage.

9 Claims, 7 Drawing Sheets

DRIVING METHOD, DRIVING MODULE AND LIQUID CRYSTAL DISPLAY DEVICE FOR ACHIEVING DOT INVERSION

CROSS REFERENCE TO RELATED APPLICATIONS

This application claims the benefit of U.S. Provisional Application No. 61/350,485, filed on Jun. 2, 2010 and entitled "Driving Method for Dual Gate Structure with Alternating Common Voltage", the contents of which are incorporated herein by reference.

BACKGROUND OF THE INVENTION

1. Field of the Invention

The present invention relates to a driving module, driving method, and liquid crystal display (LCD) device, and more particularly, to driving module, driving method, and liquid crystal display (LCD) device capable of achieving a dot inversion driving effect without changing the conventional structure and line inversion operations via shifting source voltages and a common voltage by half a horizontal synchronization signal cycle.

2. Description of the Prior Art

An LCD device utilizes a source driver and a gate driver to drive pixels on a panel to display images. Since the cost of a source driver is higher than that of a gate driver and the amount of circuitry of source driver is greater than that of a gate driver (under the situation of 480×272 pixels, since each pixel includes a red subpixel, a green subpixel, and a blue subpixel, circuitry of the source driver corresponding to 1440 data lines and circuitry of the gate driver corresponding to 272 scan lines are required), a dual gate structure is thus developed in order to reduce the amount of source drivers. In short, for the same amount of pixels, the dual gate structure has half as many data lines, and twice as many scan lines, in order to reduce the cost.

In order to avoid repeatedly driving liquid crystal molecules with voltages having the same polarity (positive or negative), thereby reducing polarization or refraction properties of the liquid crystal molecules that will deteriorate image quality, the liquid crystal molecules need to be alternately driven by positive and negative voltages, e.g. line inversion. In other words, an LCD device includes a glass substrate with a common voltage and another glass substrate with a driving circuit and liquid crystal molecules in between, and thus when the LCD device is driven in line inversion by an alternating common voltage (between −5V and 5V for low voltage driving), the alternating common voltage and a source voltage are applied to subpixels to generate a voltage difference, i.e. the source voltage minus the common voltage, to alternately drive the liquid crystal molecules with positive and negative voltage.

Please refer to FIG. 1, which is a schematic diagram of an LCD device 10 with a dual-gate structure according to the prior art. For clear illustration, the LCD device 10 only includes a source driver 100, a gate driver 102, a timing controller 104, data lines S1-Sm, scan lines G1-Gn and a pixel matrix Mat. The timing controller 104 utilizes a horizontal synchronization signal Hsync and an output enable signal Ena to control the source driver 100 and the gate driver 102, respectively, to generate data driving signals Sig_S1-Sig_Sm and gate driving signals Sig_G1-Sig_Gn, so as to charge the pixel matrix Mat. In the pixel matrix Mat, which is a dual-gate structure, each pixel includes a red subpixel RS, a green subpixel GS and a blue subpixel BS, and each subpixel includes a transistor and a capacitor, which are denoted by blocks for simplicity. In the view of columns, subpixels of every two subpixel columns are controlled by a same data line. For example, the red subpixel column RS1~RSn and the green subpixel column GS1~GSn are controlled by the data line S1, the blue subpixel column BS1~BSn and the red subpixel column RS1'~RSn' are controlled by the data line S2, and the green subpixel column GS1'~GSn' and the blue subpixel column BS1'~BSn' are controlled by the data line S3, and so on. In the view of rows, subpixels of each row are controlled by two adjacent scan lines. For example, in a row Row_1, the red pixel RS1, the blue pixel BS1 and the green pixel GS1' are controlled by the scan line G1, and the green pixel GS1, the red pixel RS1' and the blue pixel BS1' are controlled by the scan line G2. Other rows Row_2, Row_3 . . . Row_n are arranged in the same way.

Please refer to FIG. 2A to FIG. 2C. FIG. 2A is a schematic diagram of driving the pixel matrix Mat of FIG. 1 in line inversion with an alternating common voltage, and FIG. 2B and FIG. 2C are schematic diagrams of polarities of subpixels of the pixel matrix Mat of FIG. 2A in frames Fn, Fn+1, respectively. The following description utilizes FIG. 2A to illustrate operations of the red subpixel column RS1~RSn and the green subpixel column GS1~GSn corresponding to the data line S1. In detail, in a horizontal synchronization signal cycle Line2, the scan lines G1, G2 are sequentially turned on in periods Tgo, Tge, respectively, such that a source voltage Vs corresponding to the data driving signal Sig_S1 can be applied to the subpixels RS1, GS1 corresponding to the scan lines G1, G2 in periods Tso, Tse, respectively, wherein the periods Tso, Tse are half the horizontal synchronization signal cycle Line2. Since level changes of the source voltage Vs and a common voltage Vcom are synchronized with the horizontal synchronization signal Hsync, polarities of a voltage difference of the source voltage Vs minus the common voltage Vcom for charging the subpixels RS1, GS1 are positive in a frame Fn, and negative in a frame Fn+1. Similarly, in a horizontal synchronization signal cycle Line3, the subpixels RS2, GS2 corresponding to the scan lines G3, G4 are charged with negative polarities in the frame Fn, and are charged with positive polarities in the frame Fn+1. By the same token, polarities of other subpixels of the red subpixel column RS1~RSn and the green subpixel column GS1~GSn and polarities of subpixels of subpixel columns corresponding to other data lines can be derived. In such a situation, as shown in FIG. 2B and FIG. 2C, polarities of subpixels in a same row and alternating rows are the same, e.g. the row Row_1 and the row Row_3, the row Row_2 and the row Row_4, and so on, which achieves the effect of line inversion.

However, when driving the dual-gate structure in line inversion, the polarities of subpixels in the alternating rows are the same, which causes lateral crosstalk between subpixels. For example, when an image is meant to show black in the center area and grey in other areas, the left and right parts relative to the center area are lighter due to the lateral crosstalk between subpixels. Thus, there is a need for improvement.

SUMMARY OF THE INVENTION

It is therefore an objective of the present invention to provide a driving module, driving method and LCD device.

The present invention discloses a driving module for a liquid crystal display (LCD) device with a dual-gate structure. The driving module includes a data line signal processing unit, for generating a plurality of data driving signals, and a control unit, for shifting a common voltage and the plurality of data driving signals by a specific period relative to a horizontal synchronization signal. The common voltage is an alternating common voltage.

The present invention further discloses a driving method for a liquid crystal display (LCD) device with a dual-gate structure. The driving method includes steps of providing a plurality of data driving signals, and shifting a common voltage and the plurality of data driving signals by a specific period relative to a horizontal synchronization signal. The common voltage is an alternating common voltage.

The present invention further discloses a liquid crystal display (LCD) device. The LCD device includes a pixel matrix, including a dual-gate structure, which includes a plurality of red subpixel columns, a plurality of green subpixel columns and a plurality of blue subpixel columns forming a matrix according to a specific order, and a driving module, for generating a plurality of data driving signals and a common voltage. The driving module includes a data line signal processing unit, for generating the plurality of data driving signals, and a control unit, for shifting a common voltage and the plurality of data driving signals by a specific period relative to a horizontal synchronization signal. The common voltage is an alternating common voltage.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
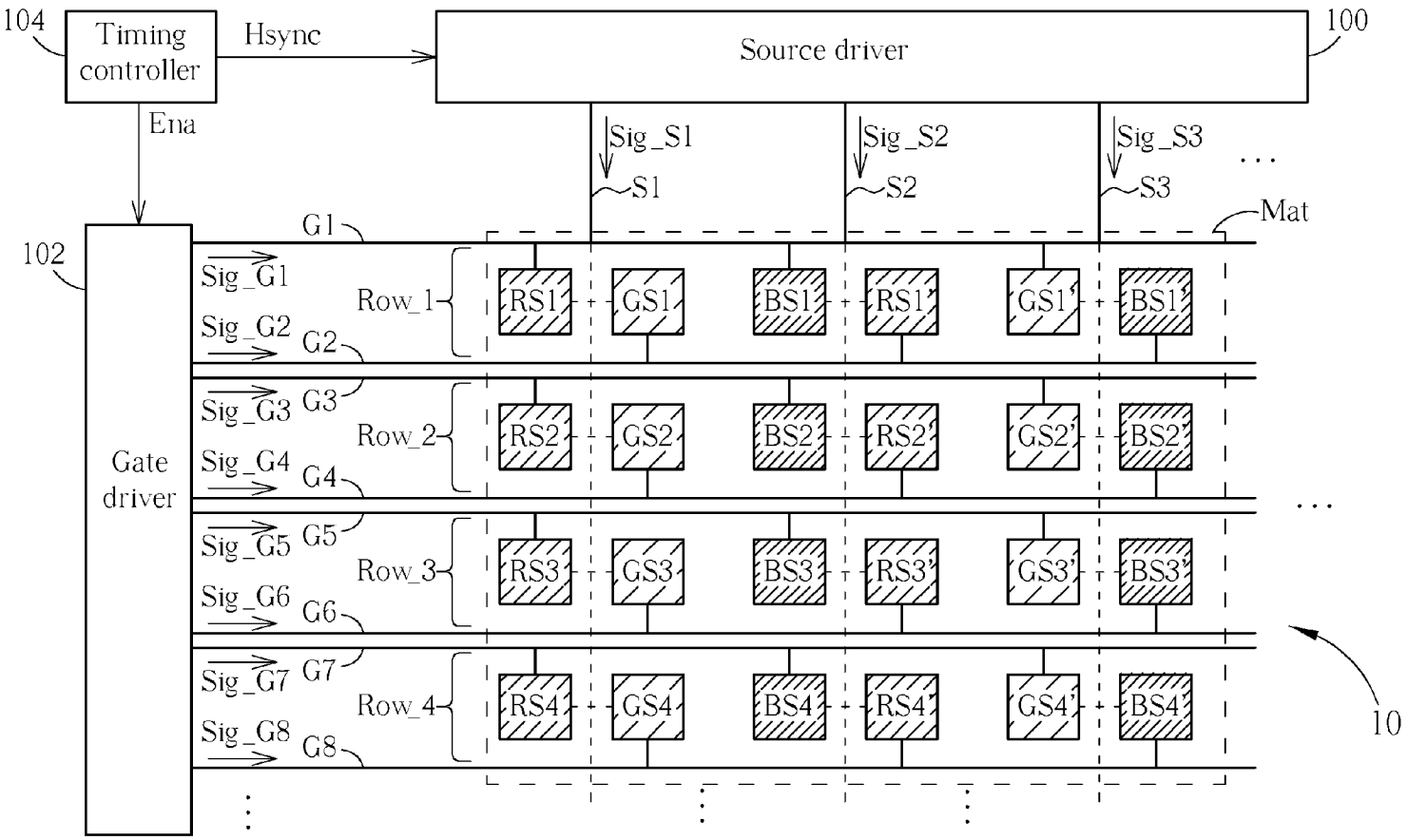
FIG. 1 PRIOR ART
FIG. 1 is a schematic diagram of an LCD device with a dual-gate structure in the prior art.
Figure 2A:
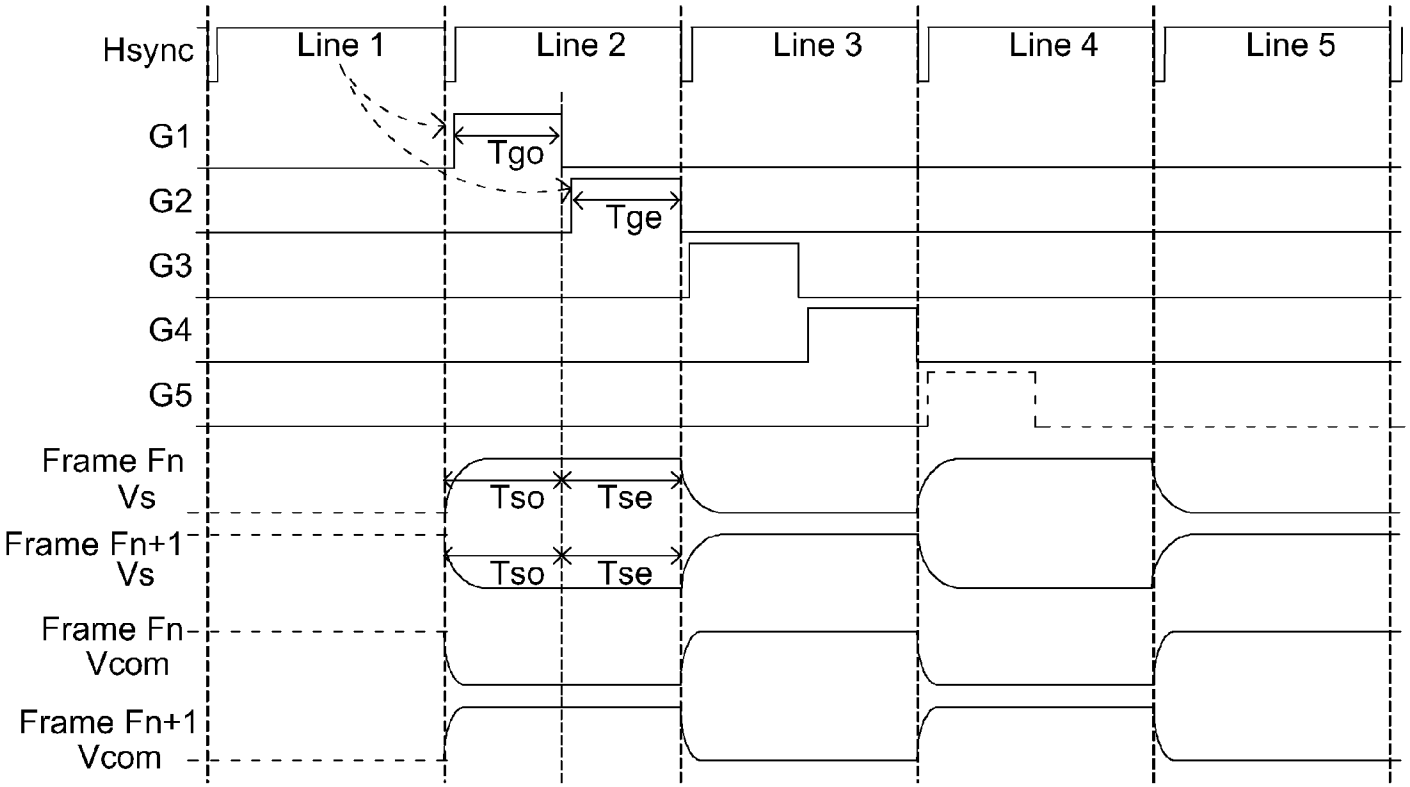
FIG. 2A PRIOR ART
FIG. 2A is a schematic diagram of driving a pixel matrix of FIG. 1 in line inversion with an alternating common voltage.
Figure 2B:
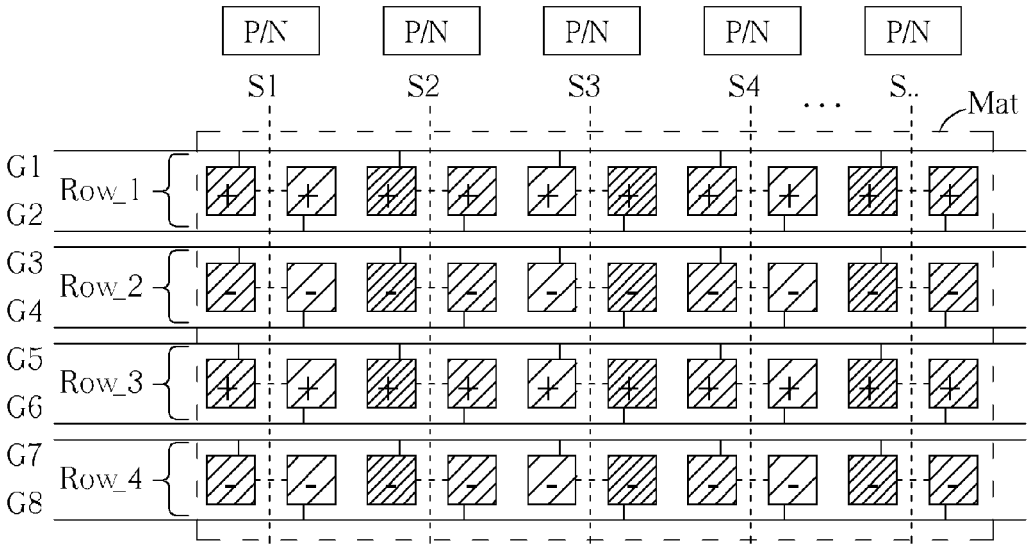
FIG. 2B PRIOR ART
FIG. 2B and FIG. 2C are schematic diagrams of polarities of subpixels of the pixel matrix of FIG. 2A in different frames.
Figure 2C:
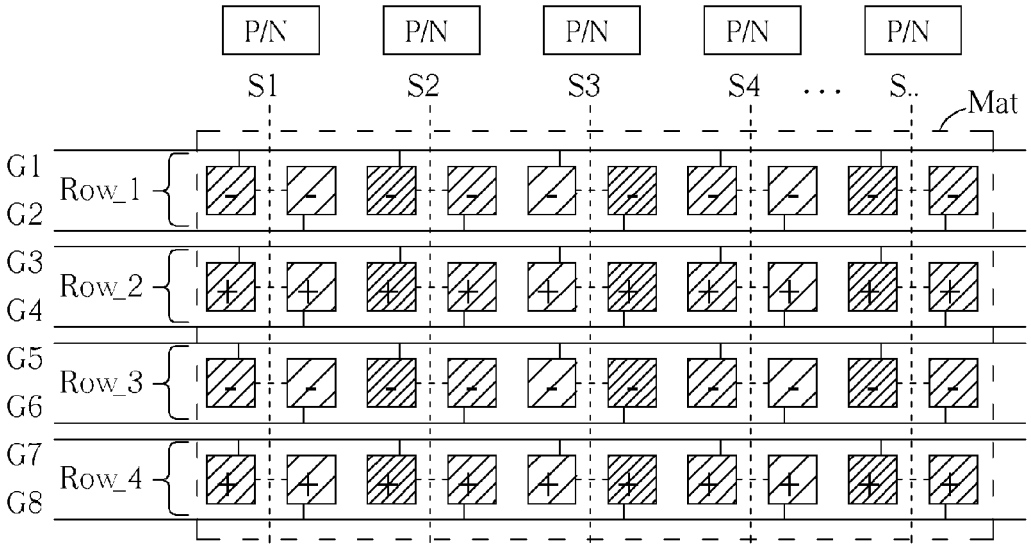
FIG. 2C PRIOR ART
Figure 3:
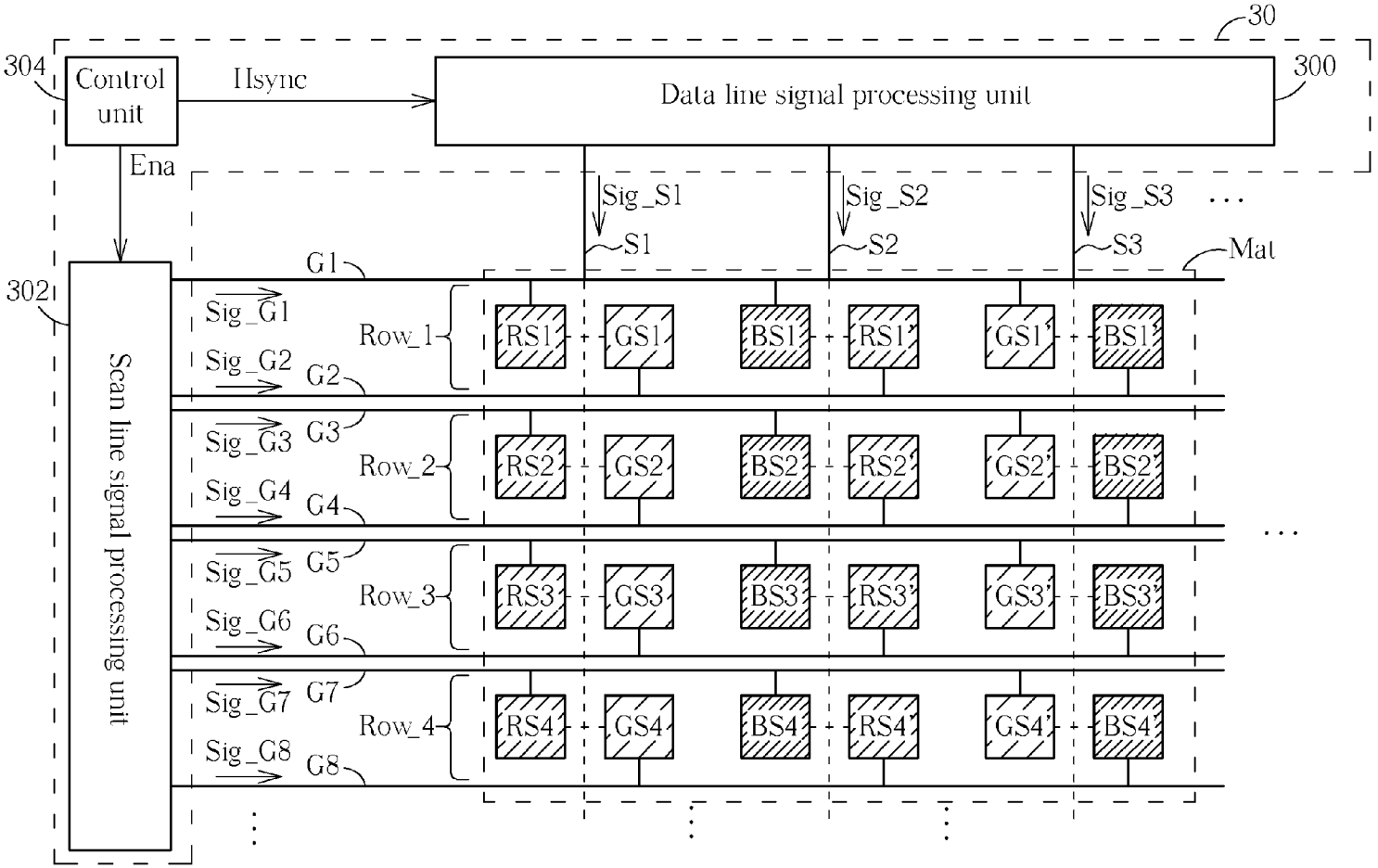
FIG. 3 is a schematic diagram of a driving module according to an embodiment of the present invention.

Please refer to FIG. 3, which is a schematic diagram of a driving module 30 according to an embodiment of the present invention. For clear illustration, elements with the same function and structure as those shown in FIG. 1 are denoted by the same figures and symbols. The driving module 30 includes a data line signal processing unit 300, a scan line signal processing unit 302 and a control unit 304. The control unit 304 generates the horizontal synchronization signal Hsync and the output enable signal Ena, to control the data line signal processing unit 300 and the scan line signal processing unit 302, so as to output the data driving signals Sig_S1-Sig_Sm to the data lines S1-Sm, and output the gate driving signals Sig_G1-Sig_Gp to the scan lines G1-Gp. The control unit 304 can shift the common voltage Vcom and the data driving signals Sig_S1-Sig_Sm by a specific period relative to the horizontal synchronization signal Hsync, to avoid lateral crosstalk between subpixels.

Figure 4A:
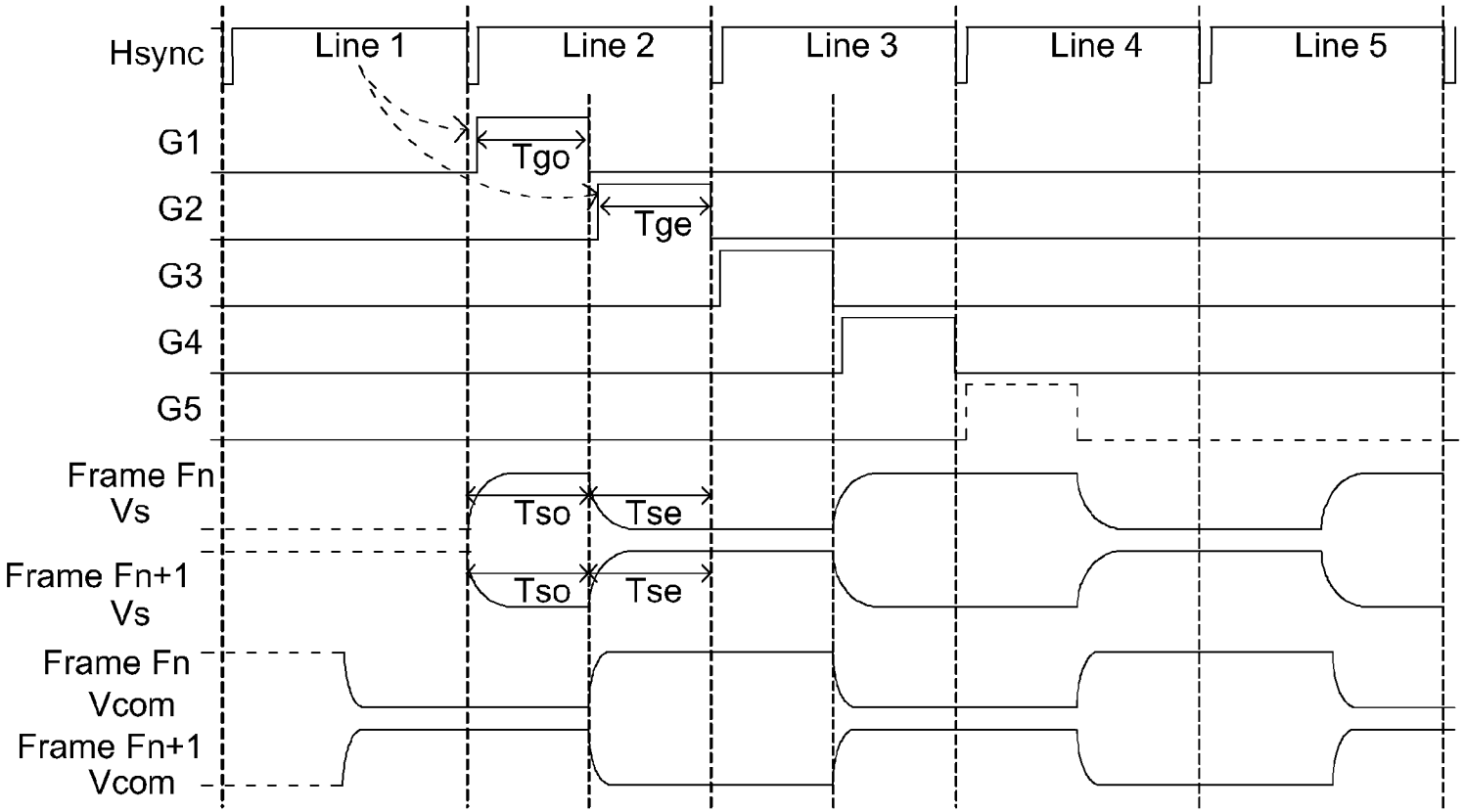
FIG. 4A is a schematic diagram of driving a pixel matrix of FIG. 1 with an alternating common voltage according to an embodiment of the present invention.
Figure 4B:
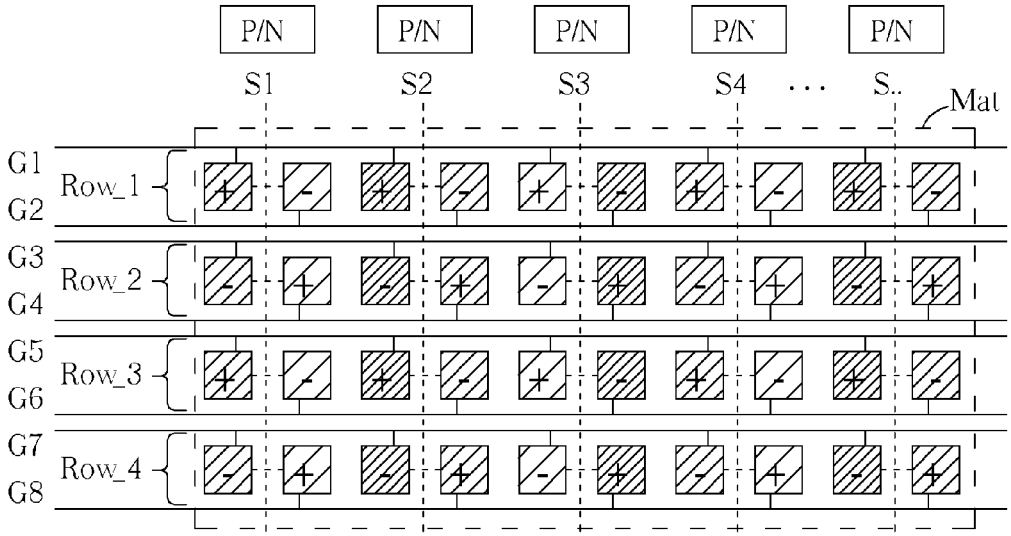
FIG. 4B and FIG. 4C are schematic diagrams of polarities of subpixels of the pixel matrix of FIG. 4A in the frames.
Figure 4C:
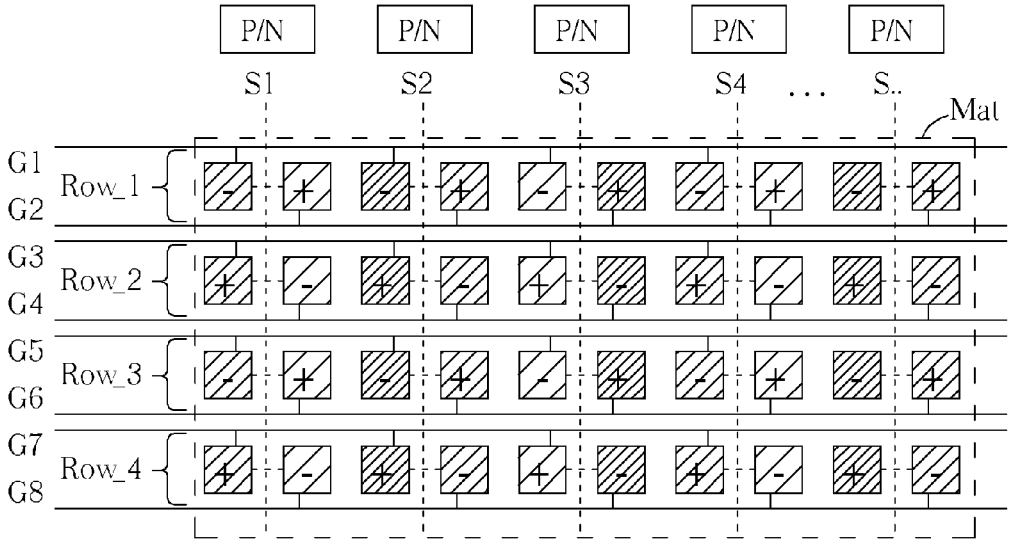

Please refer to FIG. 4A to FIG. 4C. FIG. 4A is a schematic diagram of driving the pixel matrix Mat of FIG. 3 with an alternating common voltage according to an embodiment of the present invention, and FIG. 4B and FIG. 4C are schematic diagrams of polarities of subpixels of the pixel matrix Mat of FIG. 4A in the frames Fn, Fn+1, respectively. The following description utilizes FIG. 4A to illustrate operations of the red subpixel column RS1~RSn and the green subpixel column GS1-GSn corresponding to the data line S1. In detail, as can be seen from FIG. 4A and by comparison with the prior art, the data driving signal Sig_S1 and the common voltage Vcom are shifted by half a horizontal synchronization signal cycle relative to the horizontal synchronization signal Hsync, i.e. timing of level changes of the source voltage Vs corresponding to the data driving signal Sig_S1 and the common voltage Vcom are shifted by half the horizontal synchronization signal cycle to midpoints of the horizontal synchronization signal cycle Line1~Line5. Therefore, in the horizontal synchronization signal cycle Line2, when the scan lines G1, G2 are sequentially turned on in the periods Tgo, Tge, respectively, the subpixels RS1, GS1 corresponding to the scan lines G1, G2 are charged with the voltage difference of the source voltage Vs minus the common voltage Vcom in the periods Tso, Tse, respectively. Thus, the subpixel RS1 is charged with positive polarity and the subpixel GS1 is charged with negative polarity in the frame Fn, and the subpixel RS1 is charged with negative polarity and the subpixel GS1 is charged with positive polarity in the frame Fn+1. Similarly, in the horizontal synchronization signal cycle Line3, the subpixel RS2 is charged with negative polarity and the subpixel GS2 is charged with positive polarity in the frame Fn, and the subpixel RS2 is charged with positive polarity and the subpixel GS2 is charged with negative polarity in the frame Fn+1. By the same token, polarities of other subpixels of the red subpixel column RS1~RSn and the green subpixel column GS1~GSn and polarities of subpixels of subpixel columns corresponding to other data lines can be derived. In such a situation, as shown in FIG. 4B and FIG. 4C, polarity of each subpixel is different from polarities of adjacent subpixels, which achieves the effect of dot inversion and thus can avoid lateral crosstalk between subpixels. As a result, by shifting the timing of level changes of the data driving signals Sig_S1~Sig_Sm and the common voltage Vcom by half the horizontal synchronization signal cycle relative to the horizontal synchronization signal Hsync, the present invention can achieve the effect of dot inversion, so as to avoid lateral crosstalk between subpixels.

The above description is only one embodiment of the present invention. The spirit of the present invention is to achieve the effect of dot inversion without changing the conventional structure and line inversion operations merely by shifting the timing of level changes of the data driving signals Sig_S1~Sig_Sm and the common voltage Vcom by half the horizontal synchronization signal cycle relative to the horizontal synchronization signal Hsync. Those skilled in the art may make alterations or modifications according to the concept of the present invention. For example, arrangement of the subpixel order of the pixel matrix Mat is not limited to an order of red, green, blue, as long as the pixel matrix Mat conforms to a dual-gate structure. Furthermore, how the scan line signal processing unit 302 outputs the gate driving signals Sig_G1-Sig_Gp and how the data line signal processing unit 300 and the control unit 304 are realized do not affect the scope of the present invention, as long as the spirit of the present invention can be achieved.

The driving module 30 is only utilized for illustrating operations of the present invention, and realization of the driving module 30 is not limited to software or hardware. Those skilled in the art may make proper modifications or adjust conventional driving modules to realize the driving module 30 according to system requirements. For example, if the source driver 100 in FIG. 1 only has a signal amplification function (i.e. the data driving signals Sig_S1-Sig_Sm sent to the data line S1~Sm are generated by the timing controller 104), the function of the driving module 30 can be achieved by modifying a signal output sequence of the timing controller 104, or by modifying internal circuits of the source driver 100 instead of the signal output sequence of the timing controller 104. Otherwise, if the source driver 100 in FIG. 1 has both signal amplification and processing functions (i.e. the timing controller 104 only outputs display data and timing), the function of the driving module 30 can be achieved by modifying signal processing logic of the source driver 100. All of the above description is directed to shifting the timing of level changes of the data driving signals Sig_S1~Sig_Sm and the common voltage Vcom by half the horizontal synchronization signal cycle relative to the horizontal synchronization signal Hsync, to achieve the effect of dot inversion.

Figure 5:
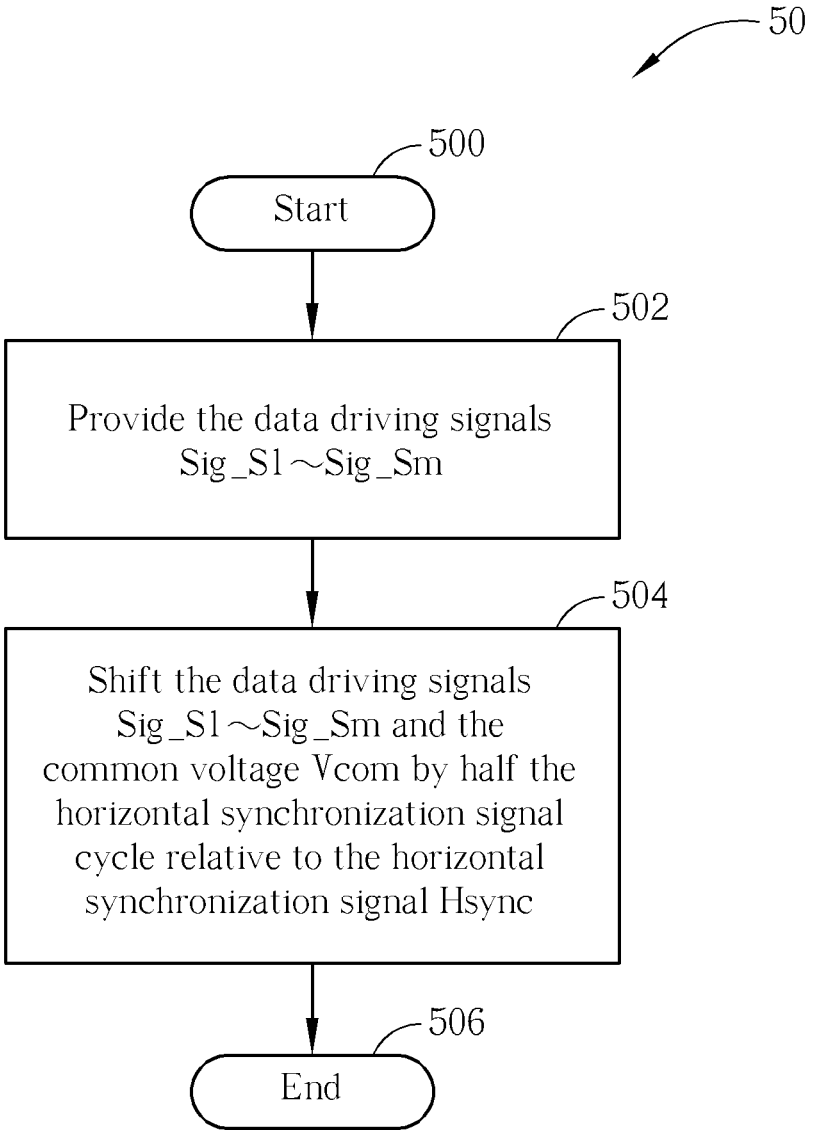
FIG. 5 is a schematic diagram of a process according to an embodiment of the present invention.

Operations of the driving module 30 can be summarized into a driving process 50 as shown in FIG. 5. The driving process 50 includes the following steps:

Step 500: Start.

Step 502: Provide the data driving signals Sig_S1-Sig_Sm.

Step 504: Shift the data driving signals Sig_S1~Sig_Sm and the common voltage Vcom by half the horizontal synchronization signal cycle relative to the horizontal synchronization signal Hsync Step 506: End.

In the prior art, when a dual-gate structure is driven in line inversion by an alternating common voltage, polarities of subpixels in alternating rows are the same, which causes crosstalk between subpixels. In comparison, the present invention can achieve the effect of dot inversion without changing the conventional structure and line inversion operations by shifting the timing of level changes of the data driving signals Sig_S1~Sig_Sm and the common voltage Vcom by half the horizontal synchronization signal cycle relative to the horizontal synchronization signal Hsync, so as to avoid lateral crosstalk between subpixels.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A driving module for a liquid crystal display (LCD) device with a dual-gate structure, comprising:

a data line signal processing unit, for generating a plurality of data driving signals; and a control unit, for shifting an initial voltage changing point of a common voltage and a plurality of initial voltage changing points of the plurality of data driving signals after the common voltage and the data driving signals reach respective initial stable voltage levels by a specific period relative to a horizontal synchronization signal along a time domain;

wherein the common voltage is an alternating common voltage.

2. The driving module of claim 1, wherein the specific period is half a horizontal synchronization signal cycle.

3. The driving module of claim 2, wherein the horizontal synchronization signal comprises a plurality of horizontal synchronization signal cycles with respective durations and the control unit controls the plurality of data driving signals and the common voltage to change voltage levels in all midpoints of all the horizontal synchronization signal cycles of the horizontal synchronization signal.

4. A driving method for a liquid crystal display (LCD) device with a dual-gate structure, comprising:

providing a plurality of data driving signals; and shifting an initial voltage changing point of a common voltage and a plurality of initial voltage changing points of the plurality of data driving signals after the common voltage and the data driving signals reach respective initial stable voltage levels by a specific period relative to a horizontal synchronization signal along a time domain;

wherein the common voltage is an alternating common voltage.

5. The driving method of claim 4, wherein the specific period is half a horizontal synchronization signal cycle.

6. The driving method of claim 5, wherein the horizontal synchronization signal comprises a plurality of horizontal synchronization signal cycles with respective durations and the driving method further comprises controlling the plurality of data driving signals and the common voltage to change voltage levels in all midpoints of all the horizontal synchronization signal cycles of the horizontal synchronization signal.

7. A liquid crystal display (LCD) device, comprising:

a pixel matrix, comprising a dual-gate structure, which comprises a plurality of red subpixel columns, a plurality of green subpixel column and a plurality of blue subpixel columns forming a matrix according to a specific order; and a driving module, for generating a plurality of data driving signals and a common voltage, comprising:

a data line signal processing unit, for generating the plurality of data driving signals; and a control unit, for shifting an initial voltage changing point of a common voltage and a plurality of initial voltage changing points of the plurality of data driving signals after the common voltage and the data driving signals reach respective initial stable voltage levels by a specific period relative to a horizontal synchronization signal along a time domain;

wherein the common voltage is an alternating common voltage.

8. The LCD device of claim 7, wherein the specific period is half a horizontal synchronization signal cycle.

9. The LCD device of claim 8, wherein the horizontal synchronization signal comprises a plurality of horizontal synchronization signal cycles with respective durations and the control unit controls the plurality of data driving signals and the common voltage to change voltage levels in all midpoints of all the horizontal synchronization signal cycles of the horizontal synchronization signal.

* * * * *